US008042617B2

(12) United States Patent
Bowles et al.

(10) Patent No.: US 8,042,617 B2
(45) Date of Patent: Oct. 25, 2011

(54) SYSTEM AND METHOD FOR DEPLOYING ONE OR MORE TOOLS IN A WELLBORE

(75) Inventors: David Bowles, Houston, TX (US); Patrick Mekolik, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 179 days.

(21) Appl. No.: 12/016,575

(22) Filed: Jan. 18, 2008

(65) Prior Publication Data

US 2008/0173441 A1 Jul. 24, 2008

Related U.S. Application Data

(60) Provisional application No. 60/881,284, filed on Jan. 19, 2007.

(51) Int. Cl.
*E21B 23/00* (2006.01)

(52) U.S. Cl. ..... 166/385; 166/241.5; 166/75.14; 166/77.51; 166/379

(58) Field of Classification Search ..... 166/75.13, 166/75.14, 77.51, 77.1, 80.1, 84.1, 85.1, 166/242.2, 241.5, 313, 378, 381, 379, 385; 251/1.1, 1.3
See application file for complete search history.

(56) References Cited

U.S. PATENT DOCUMENTS

| | | | | |
|---|---|---|---|---|
| 2,239,026 | A * | 4/1941 | Wagner | 174/91 |
| 4,681,168 | A | 7/1987 | Kisling, III | |
| 4,915,178 | A * | 4/1990 | Goldschild | 166/385 |
| 5,529,127 | A * | 6/1996 | Burleson et al. | 166/380 |
| 6,913,084 | B2 * | 7/2005 | Boyd | 166/385 |
| 2007/0119595 | A1 * | 5/2007 | Carlsen et al. | 166/368 |

OTHER PUBLICATIONS

Clamp. (n.d.). Dictionary.com Unabridged. Retrieved Jan. 19, 2011, from Dictionary.com website: http://dictionary.reference.com/browse/clamp.*

* cited by examiner

*Primary Examiner* — Shane Bomar
*Assistant Examiner* — Robert E Fuller
(74) *Attorney, Agent, or Firm* — John W. Wustenberg; Schwegman, Lundberg & Woessner, P.A.

(57) ABSTRACT

A system and method for deploying one or more tools in a wellbore according to which a clamp is coupled to a flexible interconnect.

20 Claims, 14 Drawing Sheets

SYSTEM AND METHOD FOR DEPLOYING ONE OR MORE TOOLS IN A WELLBORE

CROSS REFERENCE TO RELATED APPLICATION

This application claims the benefit of the filing date of U.S. application No. 60/881,284, filed on Jan. 19, 2007, the disclosure of which is incorporated herein by reference.

BACKGROUND

The present disclosure relates in general to oil and gas exploration, development, and/or production operations, and in particular to a system and method for deploying one or more tools in a wellbore.

DETAILED DESCRIPTION

Figure 1:
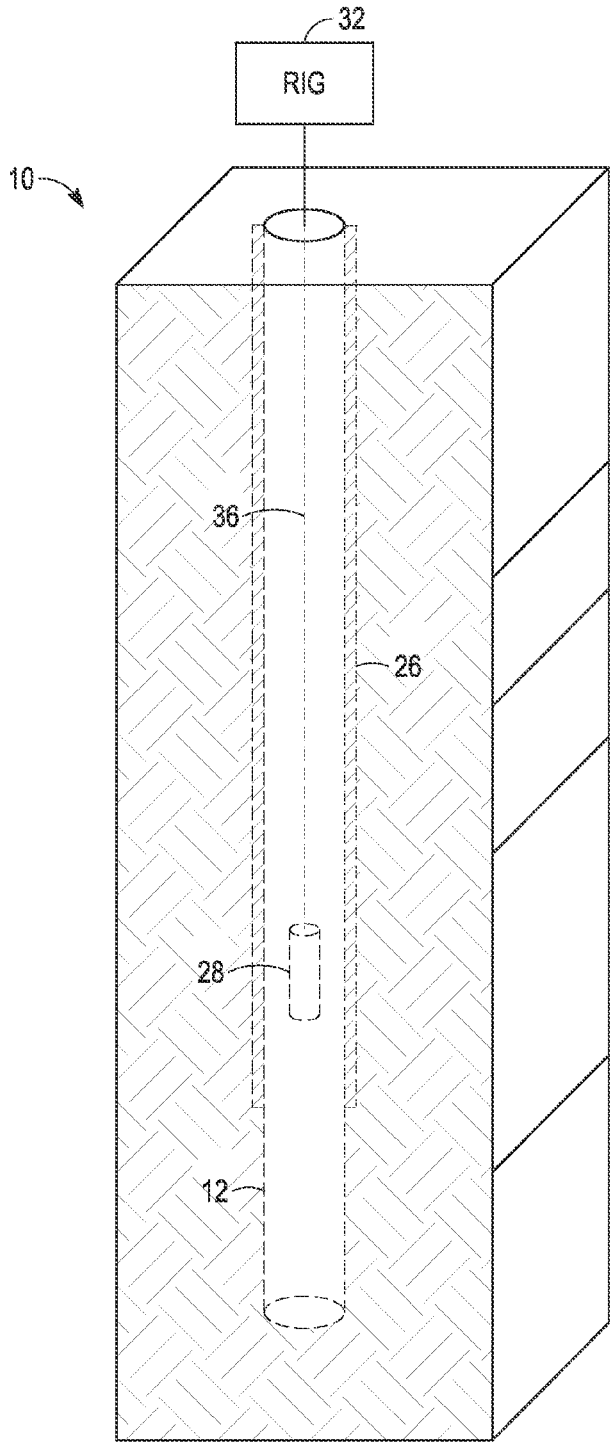
FIG. 1 is a diagrammatic view of an arrangement according to an exemplary embodiment, the arrangement including a rig, a string, and a tool, according to exemplary embodiments, respectively.

In an exemplary embodiment, as illustrated in FIG. 1, an arrangement that embodies aspects of the present disclosure is generally referred to by the reference numeral 10 and includes a pressurized wellbore 12 penetrating a subterranean ground formation including strata 14 including a plurality of geological layers 16, 18, 20, 22 and 24. In several exemplary embodiments, the wellbore 12 penetrates the strata 14 for the purpose of oil and/or gas exploration, development, and/or production. A liner or casing 26 lines a portion of the wellbore 12. In an exemplary embodiment, the casing 26 is cemented in the wellbore 12 by introducing cement in an annulus defined between the wall of the wellbore 12 and the outside surface of the casing 26. In an exemplary embodiment, the wellbore 12 includes one or more vertical wellbores, as shown in FIG. 1. In several exemplary embodiments, the wellbore 12 includes one or more vertical wellbores, one or more horizontal wellbores, one or more angularly-extending wellbores, and/or any combination thereof. In several exemplary embodiments, the wellbore 12 includes one or more cased-hole portions, and/or one or more openhole portions.

A tool 28 is lowered into the well bore 12 to a predetermined depth by a string 30, in the form of coiled tubing, jointed tubing, flexible cable, wireline, or the like, which is coupled to the upper end of the tool 28. The string 30 extends from a rig 32 that is located above ground and extends over the well bore 12. In several exemplary embodiments, the rig 32 includes support structure, a motor driven winch, or the like, and other associated equipment for receiving and supporting the tool 28, lowering the tool 28 into and/or within the wellbore 12 by, for example, unwinding the string 30 from the winch, and/or raising the tool 28 out of and/or within the wellbore 12 by, for example, winding the string 30 on the winch. In several exemplary embodiments, the tool 28 includes a series of tools, and/or one or more tools, with the series of tools and/or the one or more tools directly being coupled to one another, and/or spaced from each other along the string 30.

Figure 2:
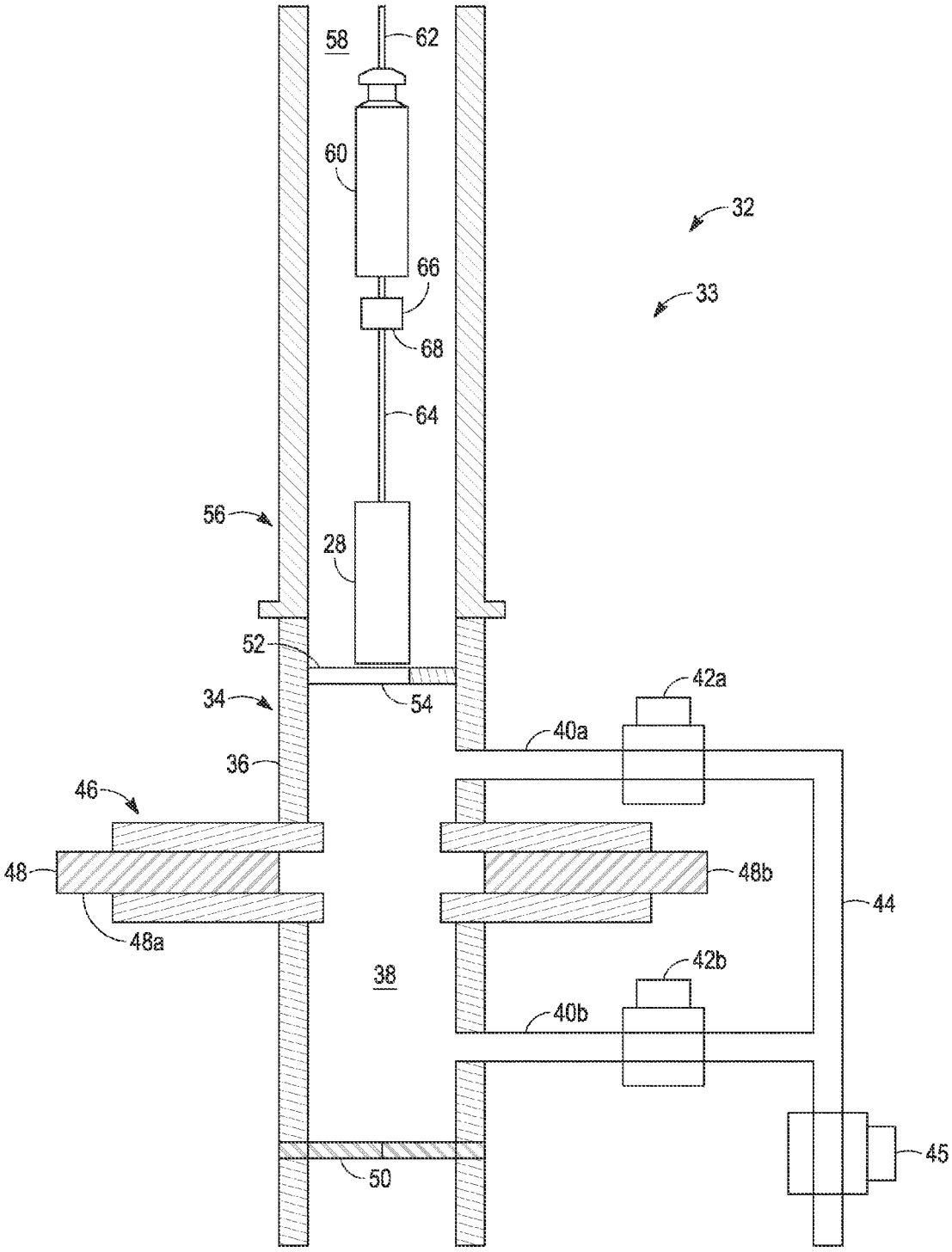
FIG. 2 is a diagrammatic view of a system of the rig of FIG. 1, according to an exemplary embodiment, the system including a cablehead to which the tool is coupled, a lubricator assembly, a pressure-containment device including an actuable sealer, a wellbore seal, a clamp, and a tool trap, according to exemplary embodiments, respectively.

In an exemplary embodiment, as illustrated in FIG. 2 with continuing reference to FIG. 1, the rig 32 includes a system 33, which includes a pressure-containment device 34 including an enclosure 36 defining an internal passage 38, and including lines 40*a* and 40*b* defining internal passages (not shown) which are fluidicly coupled to the internal passage 38. Valve assemblies 42*a* and 42*b* are coupled in an inline configuration to the lines 40*a* and 40*b*, respectively. A line 44 is coupled to the lines 40*a* and 40*b* so that an internal passage (not shown) defined by the line 44 is fluidicly coupled to the respective internal passages of the lines 40*a* and 40*b*. A valve assembly 45 is coupled in an inline configuration to the line 44.

A line sealer 46 including an actuable sealer 48 is coupled to the enclosure 36. The actuable sealer 48 includes sealing rams or mating seals 48*a* and 48*b*, which are adapted to move towards and away from each other to fluidicly isolate the portion of the internal passage 38 below the actuable sealer 48 from the portion of the internal passage 38 above the actuable sealer 48, under conditions to be described below. A wellbore seal 50 is coupled to the enclosure 36 and is positioned below the actuable sealer 48. The wellbore seal 50 is movable between a closed position (shown in FIG. 2) and an open position (shown in FIG. 4), and is adapted to seal the wellbore 12 and fluidicly isolate the portion of the internal passage 38 below the wellbore seal 50 from the portion of the internal passage 38 above the wellbore seal 50, under conditions to be described below. In an exemplary embodiment, the pressure-containment device 34 is coupled to the casing 26 (not shown in FIG. 2). In several exemplary embodiments, at least one or more of the internal passage 38, the casing 26, and the wellbore 12, including the portion of the wellbore 12 below the casing 26, define a pressurized internal passage into which the tool 24 is adapted to be lowered or deployed.

In an exemplary embodiment, the pressure-containment device 34 is, includes, and/or is a part of, a blowout preventer. In an exemplary embodiment, the line sealer 46 is, includes, and/or is a part of, a blowout preventer. In an exemplary embodiment, the wellbore seal 50 is, includes, and/or is a part of, a blowout preventer. In an exemplary embodiment, the line sealer 46 is, includes, and/or is a part of, a dual blowout preventer adapted for use with flexible interconnects and/or wireline such as, for example, fiber optic wireline. In an exemplary embodiment, the wellbore seal 50 is, includes, and/or is a part of, a dual blowout preventer adapted for use with flexible interconnects and/or wireline such as, for example, fiber optic wireline. In an exemplary embodiment, the wellbore seal 50 is coupled to a flange, which, in turn, couples the wellbore seal 50 and thus the pressure-containment device 34 to the casing 26.

A tool trap 52 is coupled to the enclosure 36 of the pressure-containment device 34 and is positioned above the line sealer 46. The tool trap 52 includes a member, such as a plate 54, which is pivotable between a horizontal, or closed, position (show in FIG. 2) and a vertical, or open, position (shown in FIG. 3). The tool trap 52 is adapted for use with flexible interconnects and/or wireline such as, for example, fiber optic wireline. In an exemplary embodiment, the plate 54 of the tool trap 52 is hydraulically actuated.

A lubricator assembly 56 defining an internal passage 58 is removably coupled to the pressure-containment device 34 so that the internal passage 58 is fluidicly coupled to the internal passage 38 of the enclosure 36 of the pressure-containment device 34. A cablehead 60 extends within the internal passage 58, and is suspended therein by a cable 62. The tool 28 extends within the internal passage 58, and is suspended therein by a flexible interconnect 64, which is coupled to, and extends between, the cablehead 60 and the tool 28. The cablehead 60 is removably coupled to the flexible interconnect 64. In an exemplary embodiment, the flexible interconnect 64 includes one or more types of flexible cable and/or one or more types of wireline, and/or any combination thereof. In several exemplary embodiments, each of the flexible interconnect 64 and the cable 62 is, includes, and/or is a part of, the string 30.

A locating device or clamp 66 defining a bottom surface 68 is coupled to the flexible interconnect 64 so that the clamp 66 is fixedly positioned along the flexible interconnect 64 and between the cablehead 60 and the tool 28.

In several exemplary embodiments, the system 33 includes one or more subs positioned between the lubricator assembly 56 and the tool trap 52, between the lubricator assembly 56 and the pressure-containment device 34, between the tool trap 52 and the pressure-containment device 34, between the tool trap 52 and the line sealer 46, between the line sealer 46 and the wellbore seal 50, between any vertically-spaced portions of the enclosure 36, below the wellbore seal 50, and/or any combination thereof. In an exemplary embodiment, a crossover (not shown) is coupled to the end of the lubricator assembly 56 opposing the pressure-containment device 34, and a grease head (not shown) is coupled to the end of the crossover opposing the lubricator assembly 56. In an exemplary embodiment, a stuffing box (not shown) is coupled to the end of the lubricator assembly 56 opposing the pressure-containment device 34.

In operation, in an exemplary embodiment, as illustrated in FIG. 2 with continuing reference to FIG. 1, the lubricator assembly 56 is removably coupled to the pressure-containment device 34, the flexible interconnect 64 is coupled to the cablehead 60, the tool 28 is coupled to the flexible interconnect 64, and the clamp 66 is coupled to the flexible interconnect 64 so that the clamp 66 is fixedly positioned along the flexible interconnect 64 and between the cablehead 60 and the tool 28, in accordance with the foregoing. The valve assemblies 42*a*, 42*b* and 45 are closed.

Figure 3:
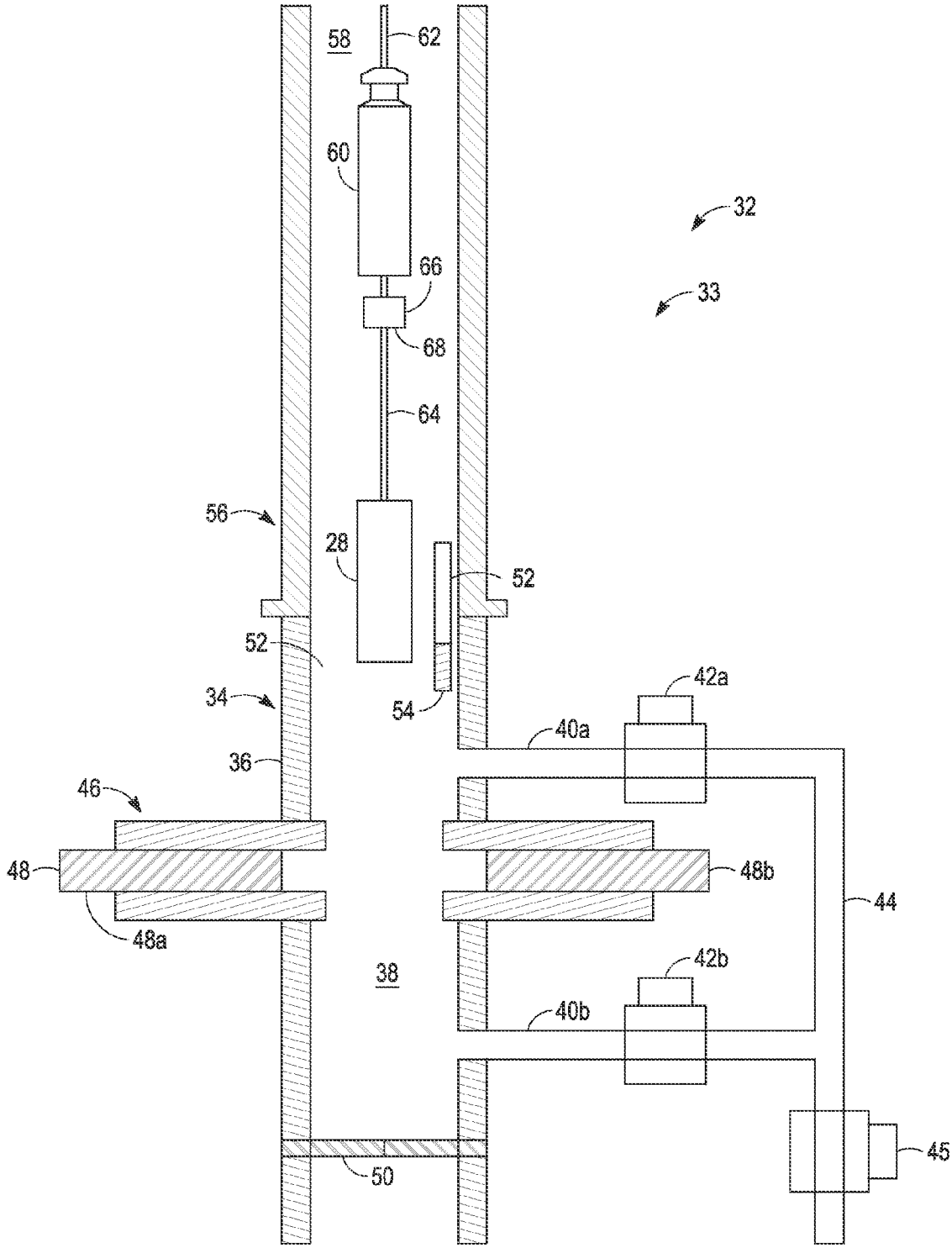
FIG. 3 is a view similar to that of FIG. 2 but depicting at least the tool trap of FIG. 2 in another operational position, according to an exemplary embodiment.

In an exemplary embodiment, as illustrated in FIG. 3 with continuing reference to FIGS. 1 and 2, the plate 54 of the tool trap 52 is pivoted from a horizontal, or closed, position to a vertical, or open, position, and the cable 62, the cablehead 60, the flexible interconnect 64, the clamp 66, and the tool 28 are lowered downward, as viewed in FIG. 3. As a result, the tool 28 is lowered past the tool trap 52 and into the internal passage 38 of the enclosure 36 of the pressure-containment device 34.

Figure 4:
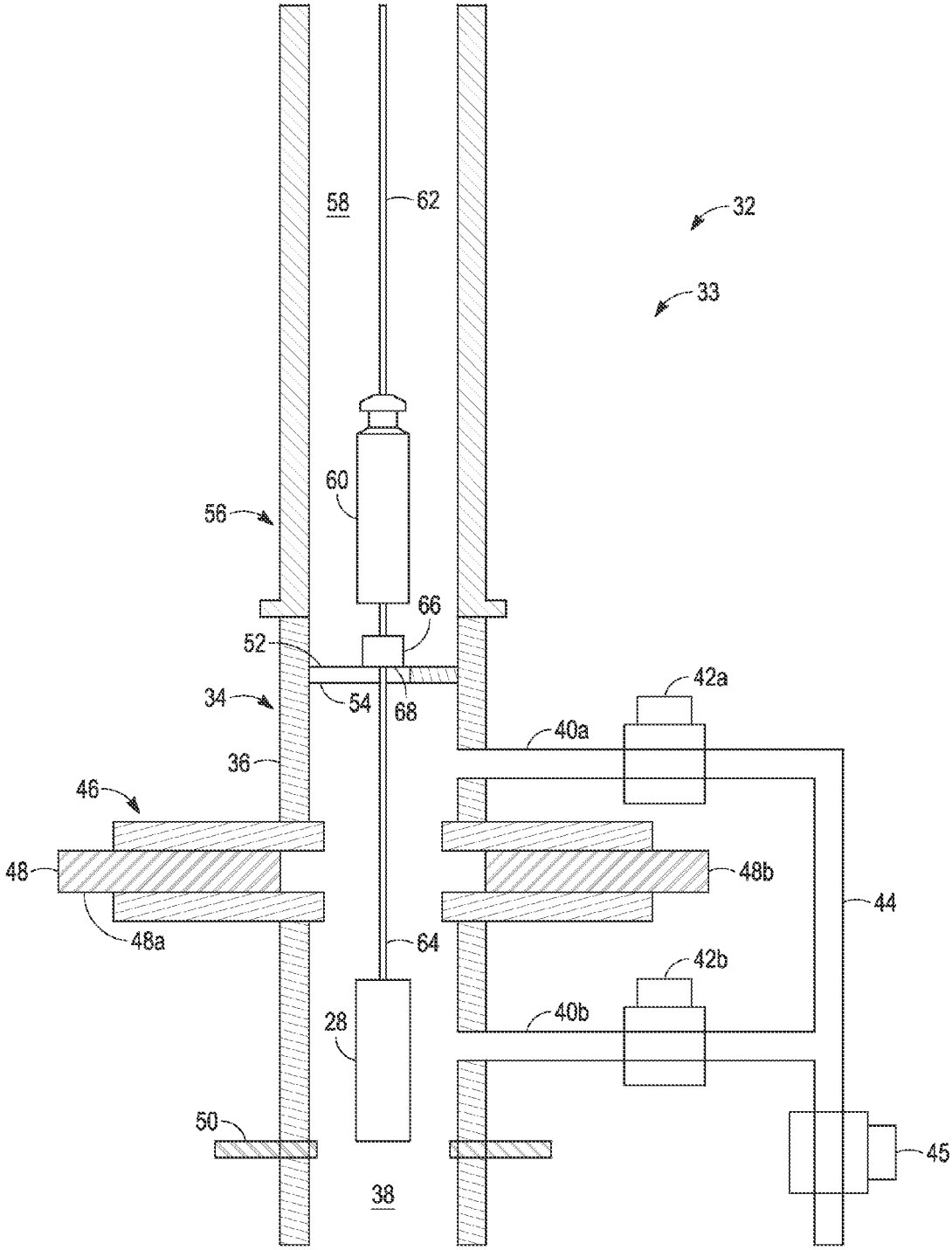
FIG. 4 is a view similar to that of FIG. 3 but depicting at least the wellbore seal in another operational position, the tool trap in another operational position, and the clamp engaged with the tool trap, according to an exemplary embodiment.

In an exemplary embodiment, as illustrated in FIG. 4 with continuing reference to FIGS. 1, 2 and 3, the tool 28 continues to be lowered into the internal passage 38 of the enclosure 36 of the pressure-containment device 34 so that the flexible interconnect 64 also moves into the internal passage 38. Before, during or after the movement of at least a portion of the flexible interconnect 64, the plate 54 of the tool trap 52 pivots from its vertical, or open, position to its horizontal, or closed position. After the plate 54 pivots to its horizontal position, the flexible interconnect 64 and the tool 28 continue to be lowered into the internal passage 38 until the surface 68 of the clamp 66 engages the plate 54, thereby resisting any further downward movement of the flexible interconnect 64 and the tool 28. At this point, a portion of the flexible interconnect 64 extends between the mating seals 48*a* and 48*b*. Moreover, the tool 28 and the portion of the flexible interconnect 64 disposed below the plate 54 of the tool trap 52 are suspended within the internal passage 38, by gravity and/or otherwise, as a result of the engagement between the surface 68 of the clamp 66 and the plate 54 of the tool trap 52, thereby placing the portion of the flexible interconnect 64 disposed below the plate 54 under tension loading. Since the clamp 66 is fixedly positioned along the flexible interconnect 64, the distance or increment between the surface 68 and the tool 28, when the portion of the flexible interconnect 64 disposed below the plate 54 is in tension, is known or predetermined. Therefore, as shown in FIG. 4, the tool 28 has been lowered by a predetermined increment from the tool trap 52, and the predetermined increment is generally equal to the distance between the tool trap 52 and the tool 28 when the portion of the flexible interconnect 64 disposed below the plate 54 is in tension.

Before, during or after the engagement of the clamp 66 with the tool trap 52, the wellbore seal 50 is placed in its open position so that the internal passage 38 is fluidicly coupled to the wellbore 12. As a result, the pressure is equal throughout the internal passages 38 and 58, and, in several exemplary embodiments, at least a portion of the casing 26 in the pressurized wellbore 12.

Figure 5:
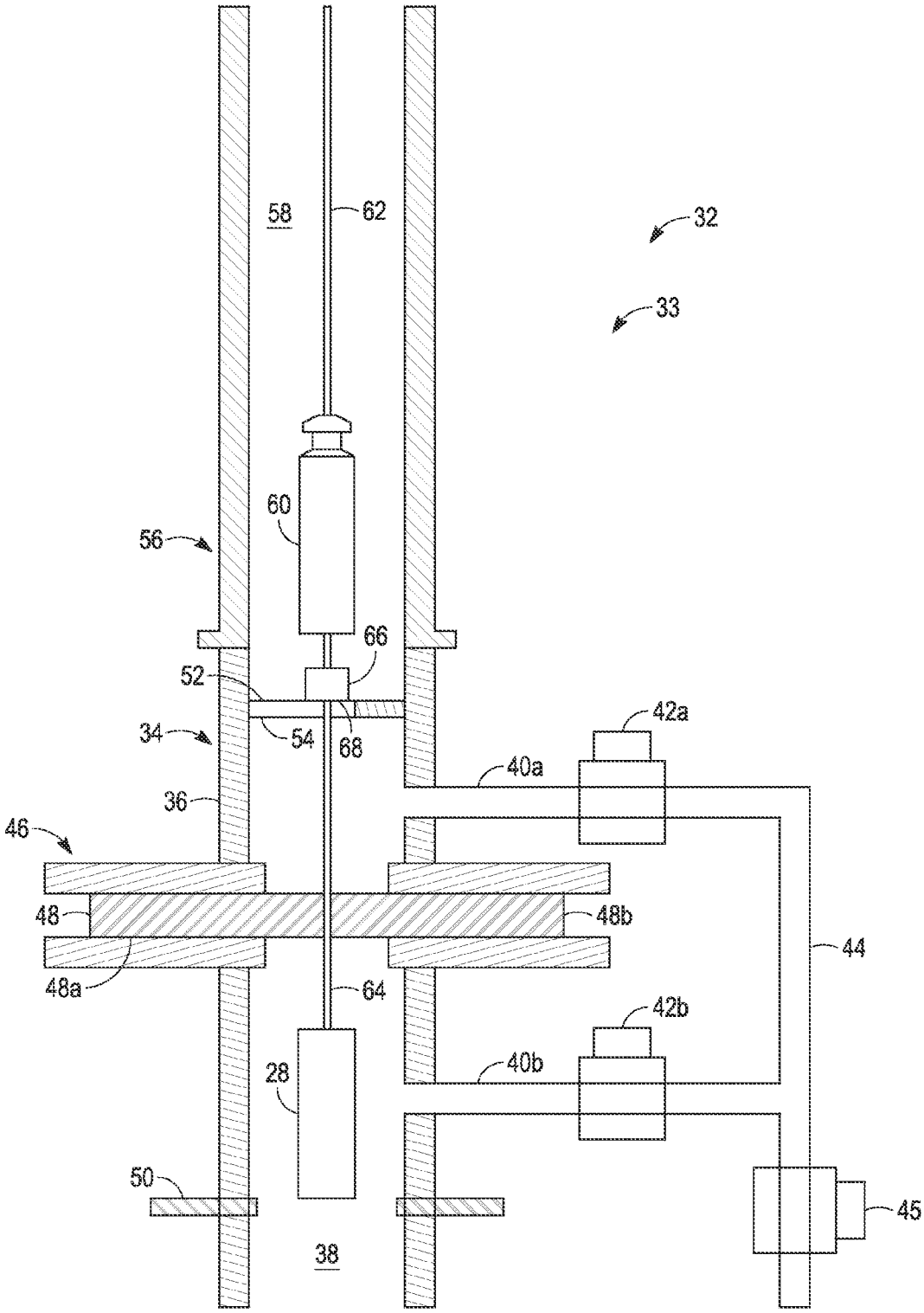
FIG. 5 is a view similar to that of FIG. 4 but depicting at least the actuable sealer in another operational position, according to an exemplary embodiment.

In an exemplary embodiment, as illustrated in FIG. 5 with continuing reference to FIGS. 1, 2, 3 and 4, the actuable sealer 48 of the line sealer 46 is actuated so that the mating seals 48*a* and 48*b* move towards each other, thereby sealingly engaging the tension-loaded portion of the flexible interconnect 64. As a result, the portion of the internal passage 38 below the actuable sealer 48 is fluidicly isolated from the portion of the internal passage 38 above the actuable sealer 48. The tension loading on the portion of the flexible interconnect 64 below the plate 54 resists any flexing of the flexible interconnect 64 that may compromise the sealing engagement between the tension-loaded portion of the flexible interconnect 64 and the mating seals 48*a* and 48*b*, thereby enabling the mating seals 48*a* and 48*b* to sufficiently sealingly engage the flexible interconnect 64 so that the portion of the internal passage 38 above the actuable sealer 48 is fluidicly isolated from the portion of the internal passage 38 below the actuable sealer 48. Thus, rigid tubing is not required to support the tool 28 in the system 33, and to provide a sufficient sealing engagement with the mating seals 48*a* and 48*b*.

The valve assemblies 42*a* and 45 are opened, while the valve assembly 42*b* remains closed. As a result, the pressure within the internal passage 38 above the actuable sealer 48 is released, and the pressure within the internal passage 58 of the lubricator assembly 56 is also released. Since the valve assembly 42*b* remains closed, and the mating seals 48*a* and 48*b* sealingly engage the tension-loaded portion of the flexible interconnect 64, the pressure within the internal passage 38 below the actuable sealer 48 is held and contained. Thus, rigid tubing is not required to support the tool 28 in the system 33, and to provide a sufficient sealing engagement with the mating seals 48*a* and 48*b*.

Figure 6:
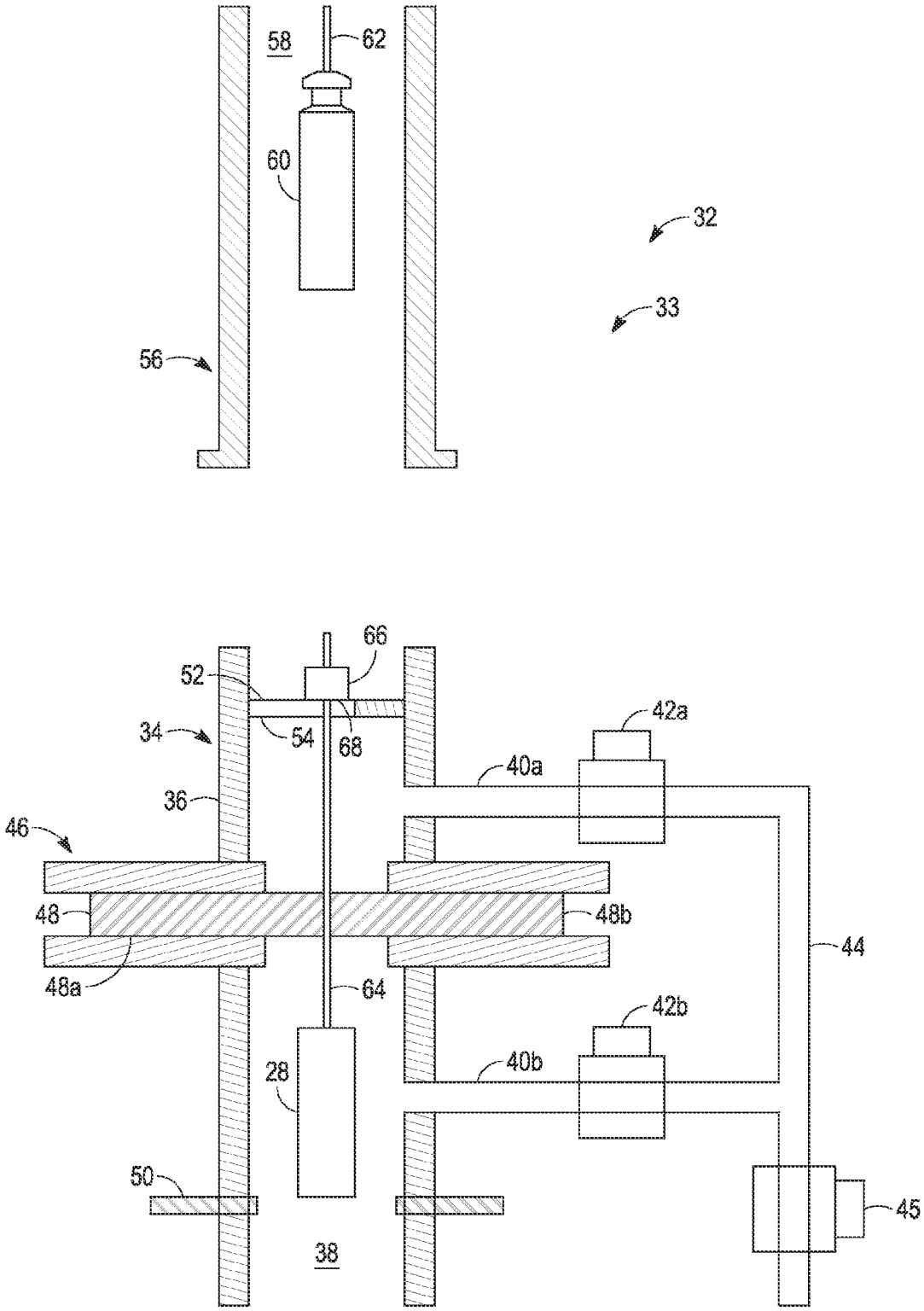
FIG. 6 is a view similar to that of FIG. 5 but depicting at least the lubricator assembly in another operational position, according to an exemplary embodiment.

In an exemplary embodiment, as illustrated in FIG. 6 with continuing reference to FIGS. 1, 2, 3, 4 and 5, the cablehead 60 is decoupled from the flexible interconnect 64, and the lubricator assembly 56 is decoupled from the pressure-containment device 34. During and after this decoupling, the pressure within the portion of the internal passage 38 below the actuable sealer 48 is held and maintained due to the sealing engagement between the mating seals 48*a* and 48*b* and the tension-loaded portion of the flexible interconnect 64, and the closed position of the valve assembly 42*b*.

Figure 7:
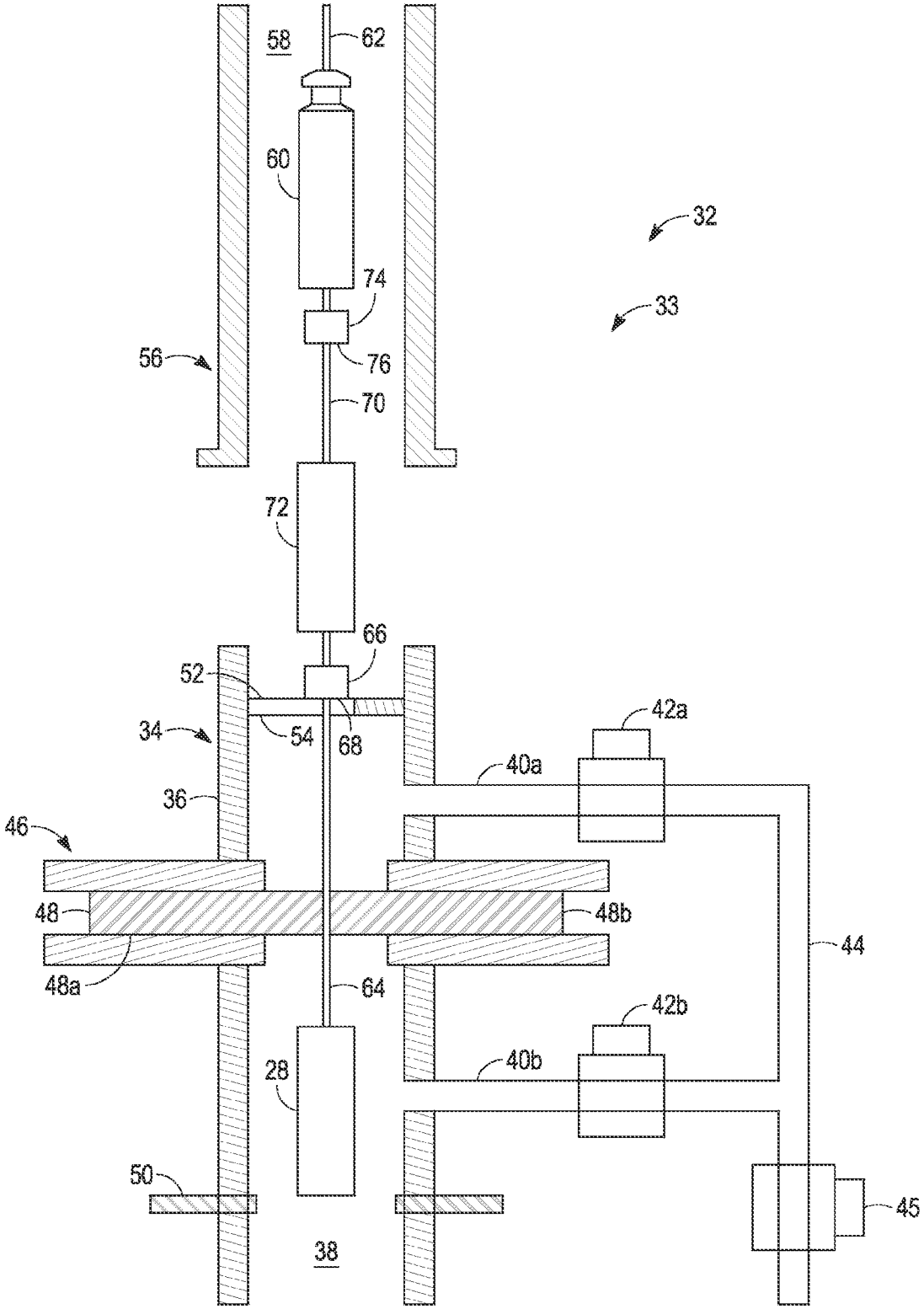
FIG. 7 is a view similar to that of FIG. 6 but depicting at least another tool coupled to the cablehead, according to an exemplary embodiment.

In an exemplary embodiment, as illustrated in FIG. 7 with continuing reference to FIGS. 1, 2, 3, 4, 5 and 6, an end of a flexible interconnect 70 is removably coupled to the cablehead 60, a tool 72 is coupled to the other end of the flexible interconnect 70, the tool 72 is coupled to the end of the flexible interconnect 64 opposing the tool 28, and a locating device or clamp 74 defining a bottom surface 76 is coupled to the flexible interconnect 70 so that the clamp 74 is fixedly positioned along the flexible interconnect 70 and between the cablehead 60 and the tool 72. The foregoing couplings are made while the pressure within the portion of the internal passage 38 below the actuable sealer 48 continues to be maintained due to the sealing engagement between the mating seals 48*a* and 48*b* and the tension-loaded portion of the flexible interconnect 64, and the closed position of the valve assembly 42*b*. In an exemplary embodiment, the flexible interconnect 70 includes one or more types of flexible cable and/or one or more types of wireline, and/or any combination thereof. In several exemplary embodiments, each of the flexible interconnect 70 and the cable 62 is, includes, and/or is a part of, the string 30. In several exemplary embodiments, the tool 72 includes a series of tools, and/or one or more tools, with the series of tools and/or the one or more tools directly being coupled to one another, and/or spaced from each other along the string 30. In several exemplary embodiments, the flexible interconnect 70 is substantially similar to the flexible interconnect 64, the clamp 74 is substantially similar to the clamp 66, and/or the tool 72 is substantially similar to the tool 28.

Figure 8:
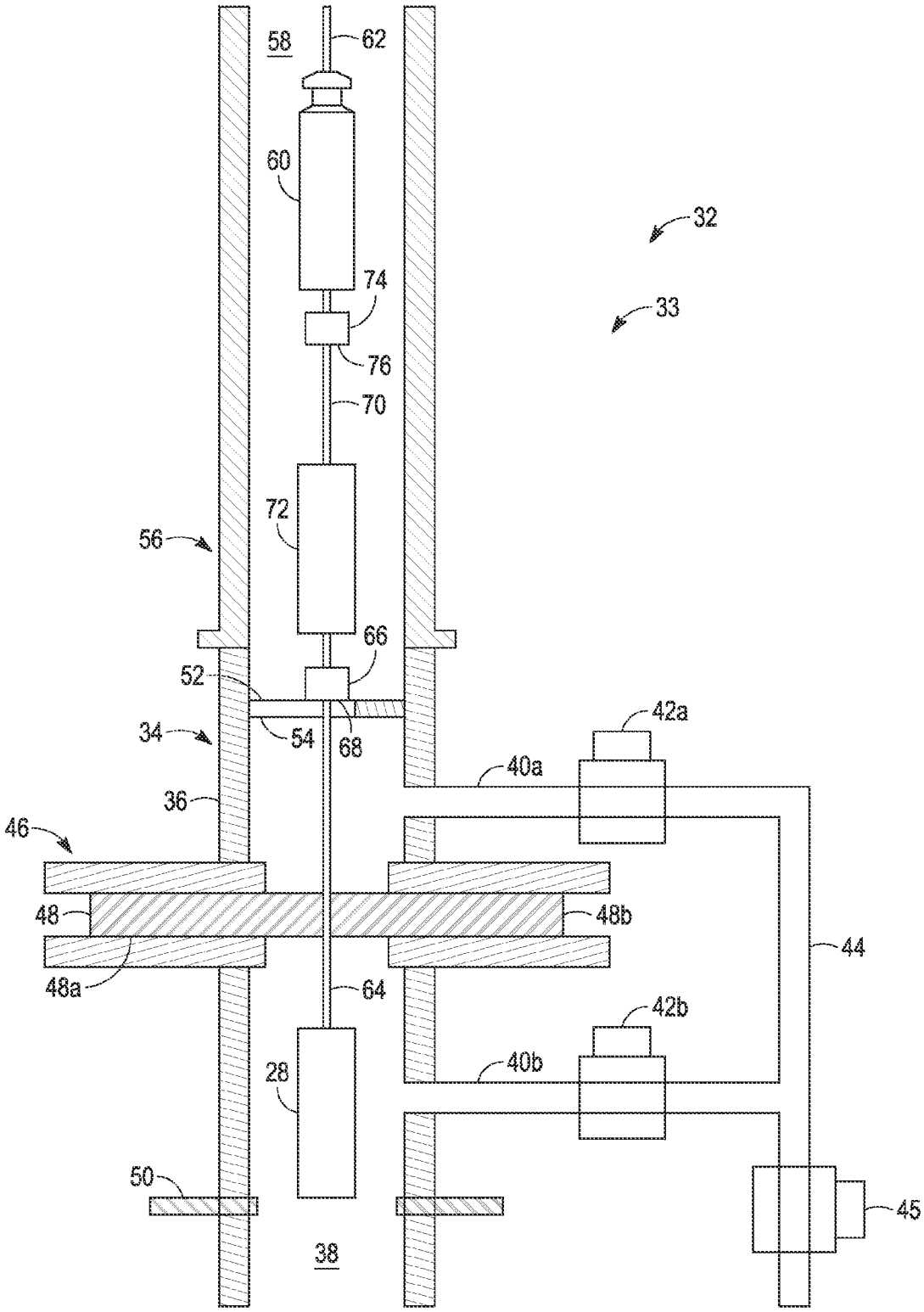
FIG. 8 is a view similar to that of FIG. 7 but depicting at least the lubricator assembly in another operational position, according to an exemplary embodiment.

In an exemplary embodiment, as illustrated in FIG. 8 with continuing reference to FIGS. 1, 2, 3, 4, 5, 6 and 7, the lubricator assembly 56 is again removably coupled to the pressure-containment device 34. The valve assembly 42*a* is closed, and the valve assembly 42*b* remains closed.

Figure 9:
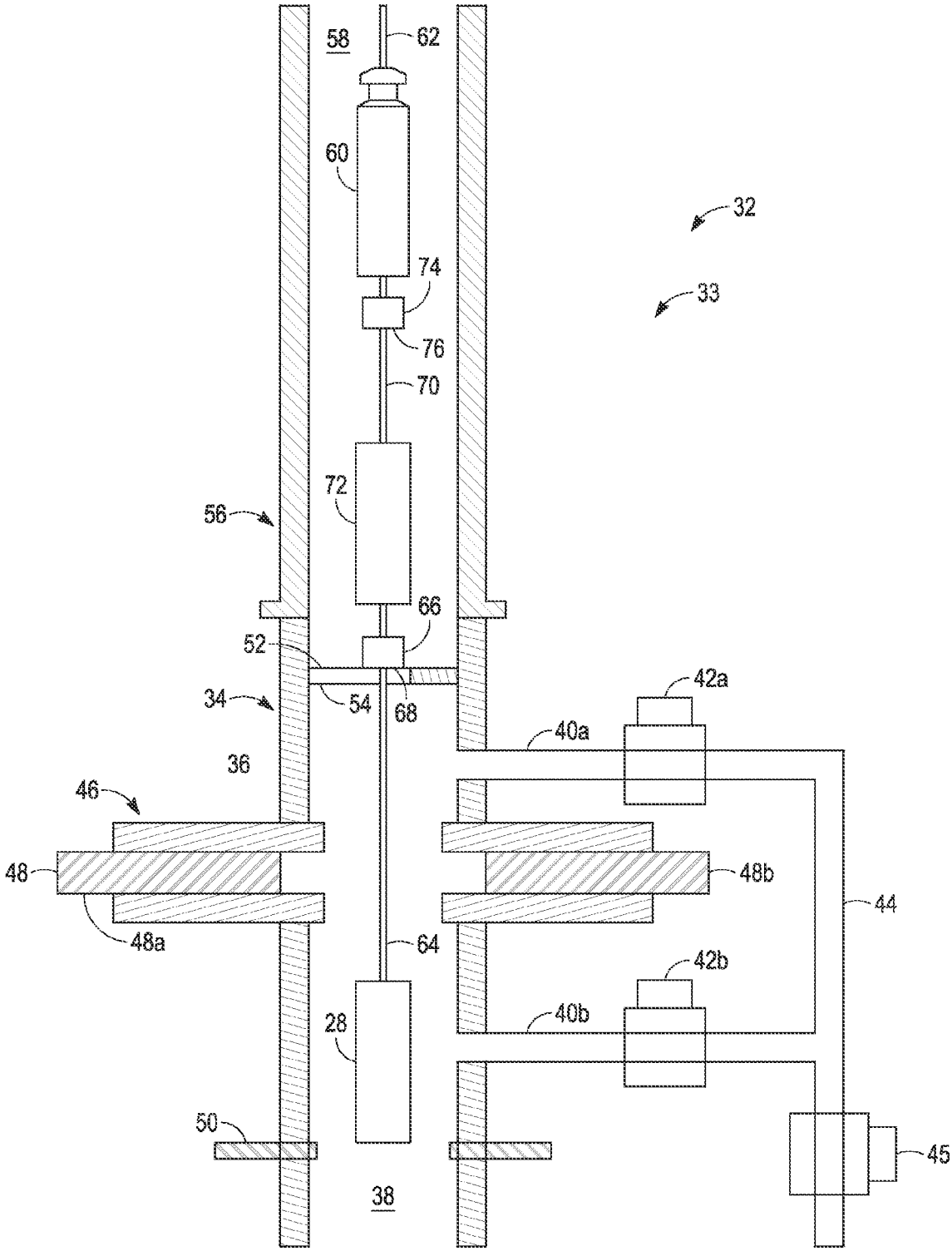
FIG. 9 is a view similar to that of FIG. 8 but depicting at least the actuable sealer in another operational position, according to an exemplary embodiment.

In an exemplary embodiment, as illustrated in FIG. 9 with continuing reference to FIGS. 1, 2, 3, 4, 5, 6, 7 and 8, the actuable sealer 48 of the line sealer 46 is actuated so that the mating seals 48*a* and 48*b* move away from each other, and thus no longer sealingly engage the tension-loaded portion of the flexible interconnect 64. As a result, and since the valve assemblies 42*a* and 42*b* are closed, the pressure is equal throughout the internal passage 38, and the internal passage 58 fluidicly coupled thereto.

Figure 10:
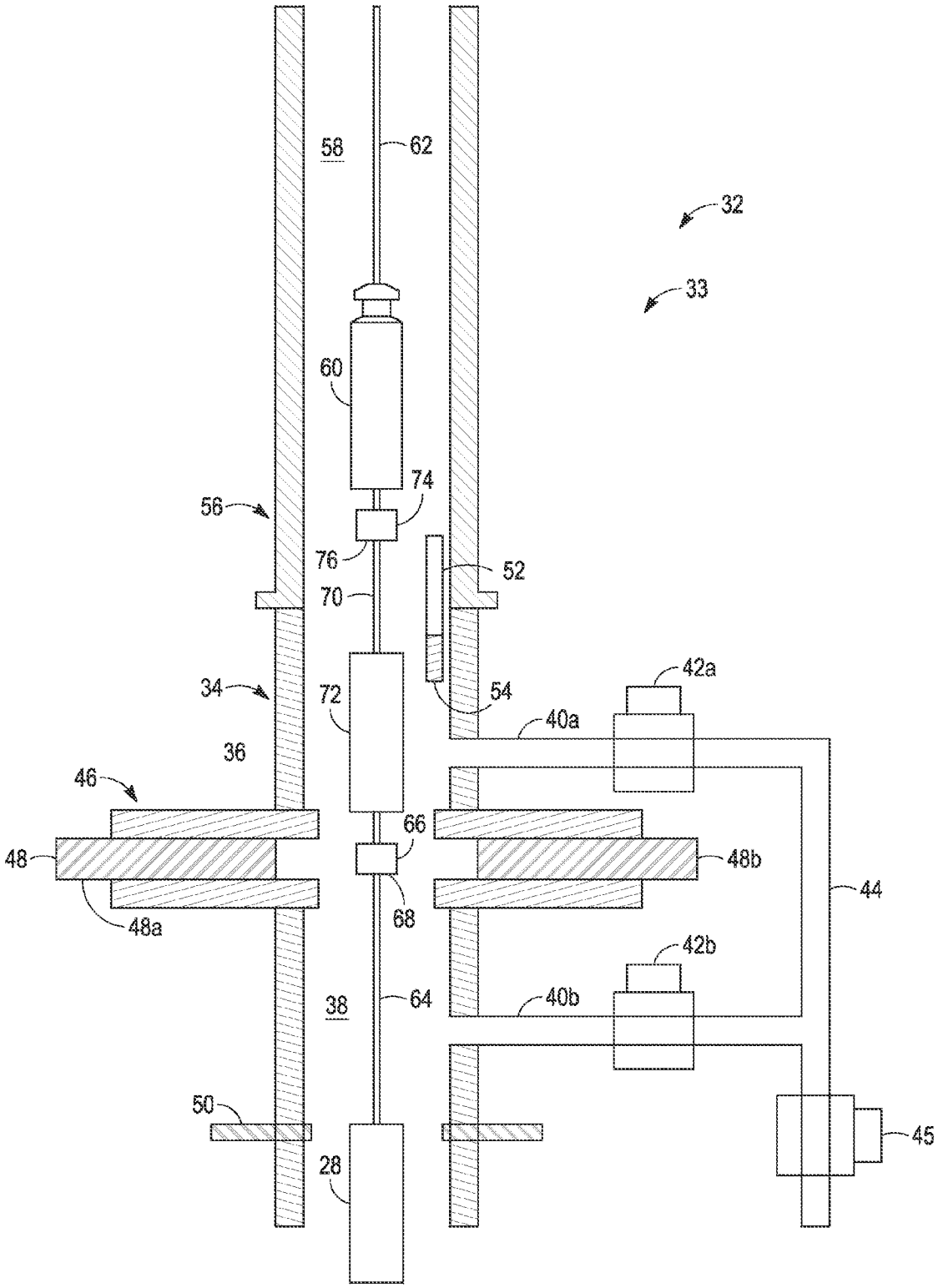
FIG. 10 is a view similar to that of FIG. 9 but depicting at least the tool trap in another operational position, according to an exemplary embodiment.

In an exemplary embodiment, as illustrated in FIG. 10 with continuing reference to FIGS. 1, 2, 3, 4, 5, 6, 7, 8 and 9, the plate 54 of the tool trap 52 is pivoted from its horizontal, or closed, position to its vertical, or open, position, and the cable 62, the cablehead 60, the flexible interconnect 70, the clamp 74, the tool 72, the flexible interconnect 64, the clamp 66, and the tool 28 are lowered downward, as viewed in FIG. 10. As a result, the tool 72 is lowered past the tool trap 52 and into the internal passage 38 of the enclosure 36 of the pressure-containment device 34, and the tool 28 is lowered further into the internal passage 38. In an exemplary embodiment, as a result of the above-described lowering of the tool 72, the tool 28 is lowered further into the internal passage 38, and into the casing 26 in the pressurized wellbore 12. In an exemplary embodiment, as a result of the above-described lowering of the tool 72, the tool 28 is lowered through the internal passage 38, through the casing 26 in the pressurized wellbore 12, and into the portion of the pressurized wellbore 12 below the casing 26.

Figure 11:
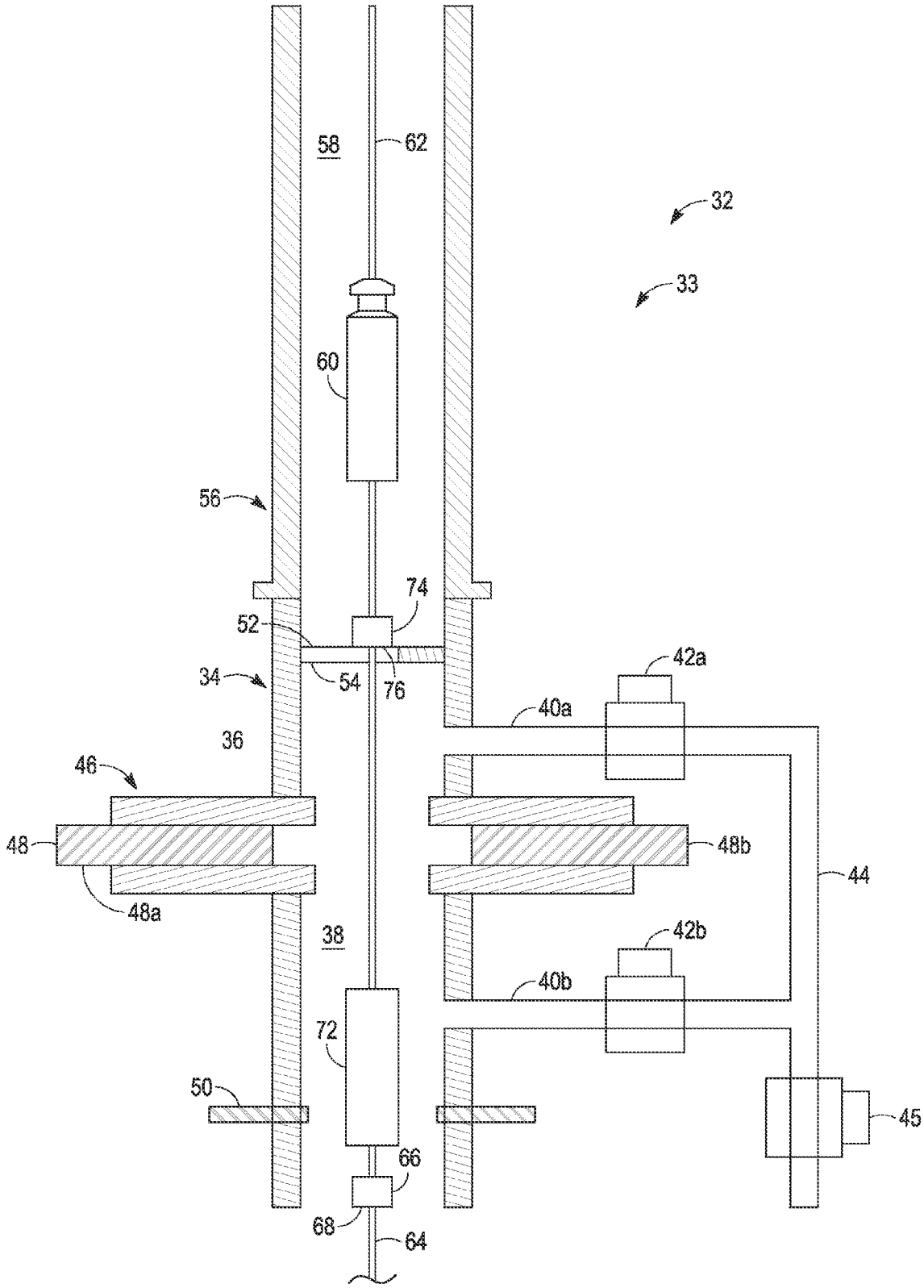
FIG. 11 is a view similar to that of FIG. 10 but depicting at least the tool trap in another operational position, and another clamp engaged with the tool trap, according to an exemplary embodiment.

In an exemplary embodiment, as illustrated in FIG. 11 with continuing reference to FIGS. 1, 2, 3, 4, 5, 6, 7, 8, 9 and 10, the cable 62, the cablehead 60, the flexible interconnect 70, the clamp 74, the tool 72, the flexible interconnect 64, the clamp 66, and the tool 28, continue to be lowered downward so that the flexible interconnect 70 moves into the internal passage 38 of the enclosure 36 of the pressure-containment device 34. Before, during or after the movement of at least a portion of the flexible interconnect 70, the plate 54 of the tool trap 52 pivots from its vertical position to its horizontal position. After the plate 54 pivots to its horizontal position, the flexible interconnect 70 continues to be lowered into the internal passage 38 until the surface 76 of the clamp 74 engages the plate 54, thereby resisting any further downward movement of the flexible interconnect 70, the tool 72, the flexible interconnect 64, the clamp 66 and the tool 28. As a result, the tool 28 has been further lowered by a predetermined increment, and the predetermined increment is substantially equal to the distance between the surface 68 of the clamp 66, and the surface 76 of the clamp 74, when the portion of the flexible interconnect 70 disposed below the plate 54, and the flexible interconnect 64, are in tension. As another result, in an exemplary embodiment, the tool 72 has been lowered by a predetermined increment, and the predetermined increment is also substantially equal to the distance between the surface 68 of the clamp 66, and the surface 76 of the clamp 74, when the portion of the flexible interconnect 70 disposed below the plate 54, and the flexible interconnect 64, are in tension.

In an exemplary embodiment, with continuing reference to FIGS. 1, 2, 3, 4, 5, 6, 7, 8, 9, 10 and 11, the actuable sealer 48 of the line sealer 46 is actuated so that the mating seals 48*a* and 48*b* move towards each other, thereby sealingly engaging the tension-loaded portion of the flexible interconnect 70. As a result, the portion of the internal passage 38 below the actuable sealer 48 is fluidicly isolated from the portion of the internal passage 38 above the actuable sealer 48. The tension loading on the portion of the flexible interconnect 70 below the plate 54 enables the mating seals 48*a* and 48*b* to sufficiently sealingly engage the flexible interconnect 70 so that the portion of the internal passage 38 above the actuable sealer 48 is fluidicly isolated from the portion of the internal passage 48 below the actuable sealer 48. The valve assemblies 42*a* and 45 are opened, while the valve assembly 42*b* remains closed. As a result, the pressure within the internal passage 38 above the actuable sealer 48 is released, and the pressure within the internal passage 58 of the lubricator assembly 56 is also released. Since the valve assembly 42*b* remains closed, and the mating seals 48*a* and 48*b* sealingly engage the tension-loaded portion of the flexible interconnect 70, the pressure within the internal passage 38 below the actuable sealer 48 is held and maintained.

The cablehead 60 is then decoupled from the flexible interconnect 70, and the lubricator assembly 56 is decoupled from the pressure-containment device 34. During and after this decoupling, the pressure within the portion of the internal passage 38 below the actuable sealer 48 is maintained due to the sealing engagement between the mating seals 48*a* and 48*b* and the tension-loaded portion of the flexible interconnect 70, and the closed position of the valve assembly 42*b*.

In an exemplary embodiment, another tool is lowered by a predetermined increment into at least the internal passage 38 of the enclosure 36 of the pressure-containment device 34, in a manner substantially similar to the above-described manner by which the tool 72 is lowered into at least the internal passage 38, or a manner substantially similar to the manner by which the tool 28 is lowered into the internal passage 38 and further into the casing 26 in the pressurized wellbore 12.

In several exemplary embodiments, multiple tools are deployed, in predetermined increments along the string 30 in the pressurized wellbore 12, in a manner substantially similar to the above-described manner by which the tools 28 and 72 are lowered by predetermined increments into at least the internal passage 38, and, in several exemplary embodiments, into the casing 26 in the pressurized wellbore 12, or through the casing 26 and into the portion of the pressurized wellbore 12 below the casing 26. In several exemplary embodiments, multiple tools are deployed in predetermined increments of, for example, up to 60 ft, along the string 30 in the pressurized wellbore 12, in a manner substantially similar to the above-described manner by which the tools 28 and 72 are lowered by predetermined increments. As a result, multiple tools can be installed into the wellbore 12 to monitor from about five to about ten times the area that is able to be monitored using other methods not in accordance with the foregoing.

In an exemplary embodiment, only one tool, such as the tool 28, is deployed in the pressurized wellbore 12 in a manner substantially similar to the manner described above.

In an exemplary embodiment, only the tools 28 and 72 are deployed in the pressurized wellbore 12 in a manner substantially similar to the manner described above.

In an exemplary embodiment, the tools 28 and 72 are deployed in a horizontal section of the wellbore 12, and the flexible interconnects 64 and 70 permit the string 30 to bend and enter the horizontal section in response to, for example, a tractor pulling the string 30 through the horizontal section.

Figure 12:
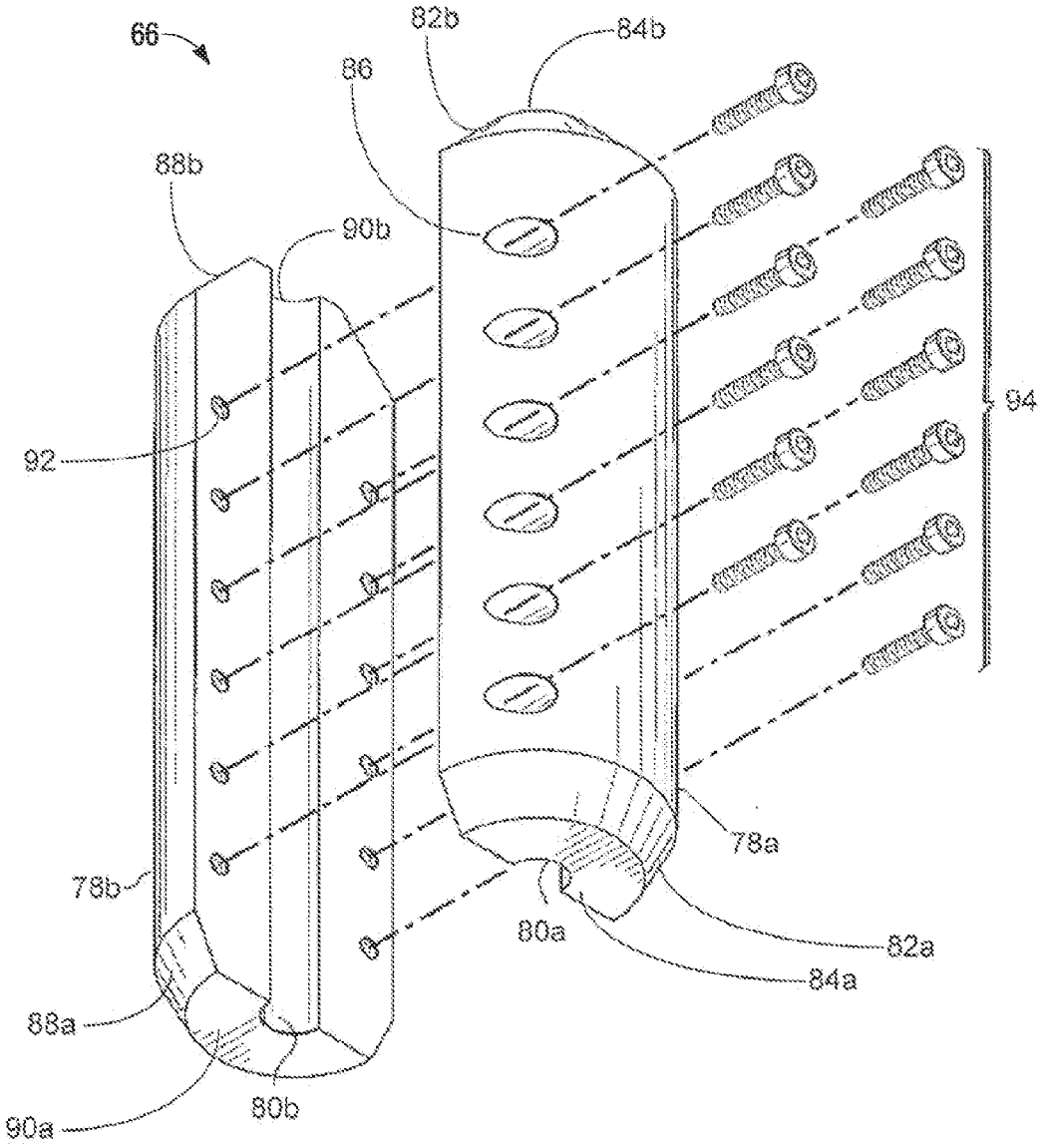
FIG. 12 is an exploded perspective view of a clamp according to an exemplary embodiment.

In an exemplary embodiment, as illustrated in FIG. 12 with continuing reference to FIGS. 1, 2, 3, 4, 5, 6, 7, 8, 9, 10 and 11, the clamp 66 includes longitudinally extending body members 78*a* and 78*b* having channels 80*a* and 80*b*, respectively, formed therein, the channels 80*a* and 80*b* having respective arcuate cross-sections and extending along the longitudinal lengths of the members 78*a* and 78*b*, respectively. The member 78*a* includes opposing tapered end portions 82*a* and 82*b*, which define opposing end surfaces 84*a* and 84*b*, respectively. The opposing end surfaces 84*a* and 84*b* are perpendicular to the direction of longitudinal extension of the member 78*a* and the channel 80*a*. A plurality of through-openings 86 extend through the member 78*a* in a direction that is perpendicular to the direction of longitudinal extension of the member 78*a* and the channel 80*a*. The plurality of through-openings 86 are arranged on either side of the channel 80*a*, in two longitudinally-extending columns, one of which is shown in FIG. 12. The member 78*b* includes opposing tapered end portions 88*a* and 88*b*, which define opposing end surfaces 90*a* and 90*b*, respectively. The opposing end surfaces 90*a* and 90*b* are perpendicular to the direction of longitudinal extension of the member 78*b* and the channel 80*b*. A plurality of bores 92 having respective internal threaded connections extend in the member 78*b* in a direction that is perpendicular to the direction of longitudinal extension of the member 78*b* and the channel 80*b*. The plurality of bores 92 are arranged on either side of the channel 80*b*, in two longitudinally-extending columns, so that each bore in the plurality of bores 92 is adapted to be axially aligned with a corresponding through-opening in the plurality of through-openings 86, under conditions to be described. The clamp 66 further includes a plurality of fasteners 94, each of which is adapted to extend through a corresponding through-opening 86 and into a corresponding bore 92 adapted to be axially aligned therewith.

Figure 13:
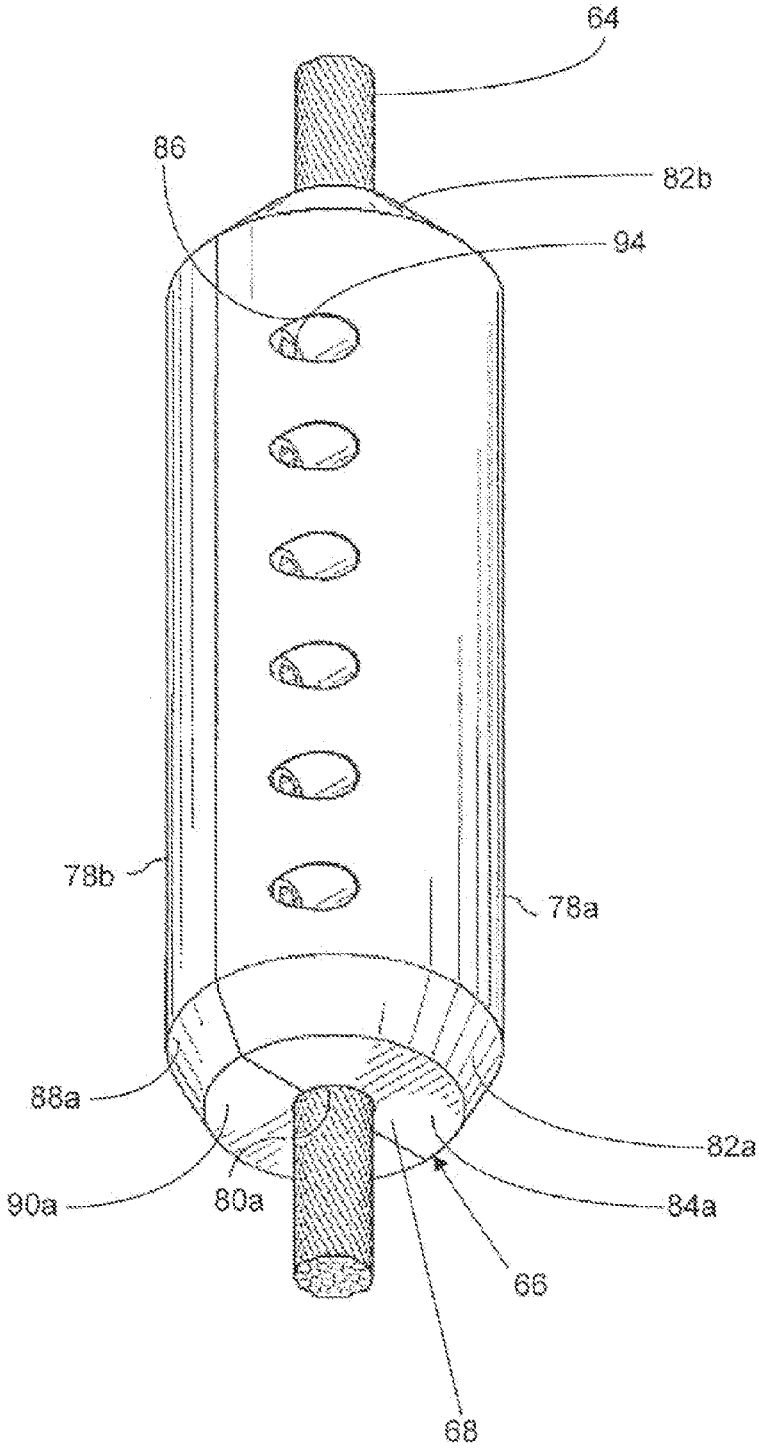
FIG. 13 is an unexploded perspective view of the camp of FIG. 12 coupled to a flexible interconnect, according to an exemplary embodiment.

In an exemplary embodiment, as illustrated in FIG. 13 with continuing reference to FIGS. 1, 2, 3, 4, 5, 6, 7, 8, 9, 10, 11 and 12, to couple the clamp 66 to the flexible interconnect 64, in accordance with the foregoing, the members 78*a* and 78*b* of the clamp 66 are positioned on opposing sides of the flexible interconnect 64, and are moved towards one another, so that the channels 80*a* and 80*b* form an internal passage having a circular cross-section through which the flexible interconnect 64 extends, and the through-openings 86 are axially aligned with the bores 92, respectively. The fasteners 94 are inserted through the through-openings 86, respectively, and into the bores 92, respectively, and are threadably engaged with the internal connections of the bores 92, respectively, thereby clamping the members 78*a* and 78*b* together. As a result, the clamp 66 is coupled to, and fixedly positioned along, the flexible interconnect 64.

As shown in FIG. 13, when the clamp 66 is coupled to the flexible interconnect 64, the end surfaces 84*a* and 90*a* collectively define the surface 68, which is adapted to engage the plate 54 of the tool trap 52, as described above. Also, the tapered end portions 82*a* and 88*a* collectively form a tapered end portion that extends circumferentially about the flexible interconnect 64, and the tapered end portions 82*b* and 88*b* collectively form a tapered end portion that also extends circumferentially about the flexible interconnect 64, and these collective tapered end portions reduce the likelihood of the clamp 66 being caught on, and/or interfering with, any component, during the extension of the clamp 66 in the lubrication assembly 56, and the lowering of the clamp 66 into the internal passage 58, the internal passage 38, the casing 26 in the pressurized wellbore 12, and/or the portion of the pressurized wellbore 12 below the casing 26, during the above-described operation of the system 33.

Figure 14:
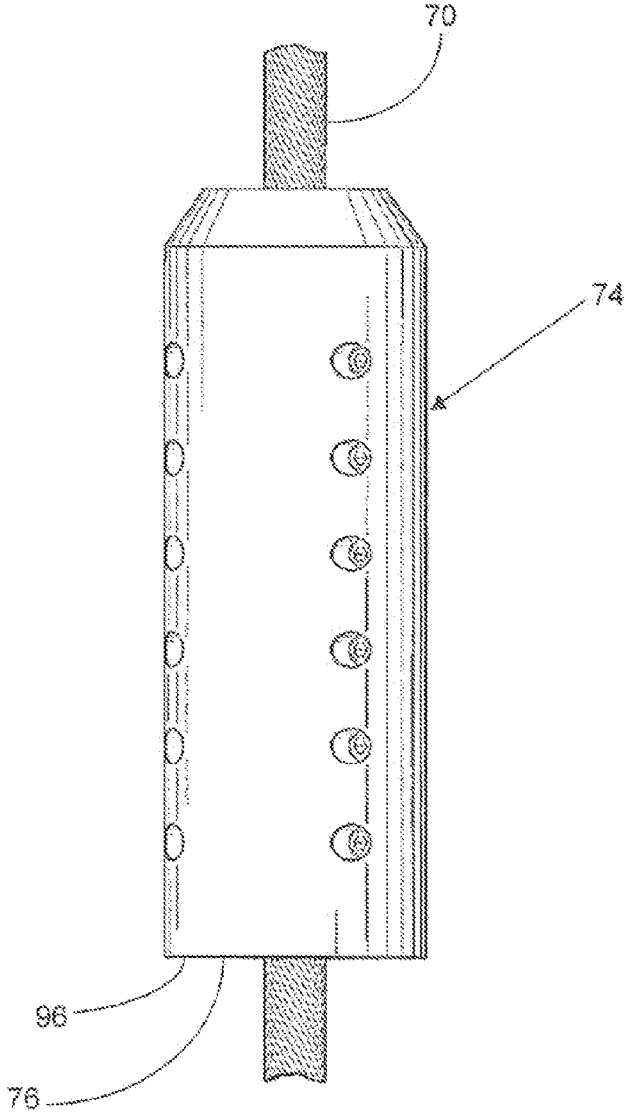
FIG. 14 is a perspective view of another clamp coupled to a flexible interconnect, according to an exemplary embodiment.

In an exemplary embodiment, as illustrated in FIG. 14 with continuing reference to FIGS. 1, 2, 3, 4, 5, 6, 7, 8, 9, 10, 11, 12 and 13, the clamp 74 is substantially similar to the clamp 66 and therefore will not be described in detail, except that the clamp 74 does not include opposing tapered end portions, and instead only includes one tapered end portion at the upper end of the clamp 74, as viewed in FIG. 14, when the clamp 74 is coupled to, and fixedly positioned along, the flexible interconnect 70. The lower end of the clamp 74, as viewed in FIG. 14, does not include a tapered end portion, and instead includes a square or flat end 96 that defines the surface 76. The clamp 74 is coupled to the flexible interconnect 70 in a manner substantially similar to the above-described manner by which the clamp 66 is coupled to the flexible interconnect 64. In several exemplary embodiments, the flat end 96 of the clamp 74 increases the surface area of the surface 76, thereby facilitating the engagement of the surface 76 of the clamp 74 with the plate 54 of the tool trap 52, during the above-described operation of the system 33.

In an exemplary experimental embodiment, experimental testing was conducted using an exemplary experimental embodiment of the system 33, including exemplary experimental embodiments of the actuable sealer 48, and the flexible interconnect 64 and/or 70. During the experimental testing, one or more tools substantially similar to the tools 28 and/or 72, and having the one or more experimental exemplary embodiments of the flexible interconnect 64 and/or 70 coupled thereto, were successfully experimentally deployed in a pressurized experimental wellbore, in accordance with the above-described operation of the system 33. This was an unexpected result. The experimental sealing engagement between the one or more tension-loaded portions of the exemplary experimental embodiments of the flexible interconnect 64 and/or 70, and the exemplary experimental embodiment of the actuable sealer 48, was sufficient to permit the successful experimental deployment of the one or more tools in the pressurized experimental wellbore, in accordance with the above-described operation of the system 33. This was an unexpected result.

In an exemplary embodiment, one or more of the tools 28 and/or 72 are DS150 microseismic tools. In several exemplary embodiments, one or more of the tools 28 and/or 72 include logging tools, such as casing collar locators (CCLs), gamma-ray logging tools, neutron logging tools, and/or other types of logging tools. In several exemplary embodiments, one or more of the tools 28 and/or 72 include tools used to monitor production, hydraulic fracture growth, steam injection, and/or other features. In an exemplary embodiment, one or more of the tools 28 and/or 72 are seismic sources, such as, for example, perforating guns, string shots, primacord wrapped around a perforation gun or other tool, other triggered seismic sources, other types of devices capable of generating a seismic event, and/or any combination thereof. In an exemplary embodiment, one or more of the tools 28 and/or 72 include perforating gun simulators.

In several exemplary embodiments, instead of, or in addition to the flexible interconnects 64 and 70, the clamps 66 and/or 74 may be coupled to, and/or fixedly positioned on, other components in the system 33, the rig 32, and/or the arrangement 10.

In several exemplary embodiments, the clamps 66 and 74 are coupled to the flexible interconnects 64 and 70 by one or more clamps, fasteners, welded joints, brazed joints, adhesives, bonded joints, magnetic couplers, hydraulic couplers, other types of joints, wrapping arrangements, other fastening or coupling devices, system and methods, and/or any combination thereof.

A method has been described that includes coupling a first flexible interconnect to a first tool; disposing at least the first flexible interconnect and the first tool in a pressurized internal passage; placing at least a portion of the first flexible interconnect under tension loading; and sealingly engaging the tension-loaded portion of the first flexible interconnect so that a first portion of the internal passage is fluidicly isolated from a second portion of the internal passage. In an exemplary embodiment, the tension loading resists any flexing of the tension-loaded portion of the first flexible interconnect to thereby facilitate the sealing engagement; and wherein placing the at least a portion of the first flexible interconnect under tension loading comprises coupling a first clamp to the first flexible interconnect; engaging the first clamp with a tool trap; and suspending at least the first tool by the first flexible interconnect in response to engaging the first clamp with the tool trap. In an exemplary embodiment, the method comprises releasing the pressure in the first portion of the internal passage while continuing to sealingly engage the tension-loaded portion of the first flexible interconnect so that the pressure in the second portion of the internal passage is contained. In an exemplary embodiment, the method comprises coupling a second tool to the first flexible interconnect; coupling a second flexible interconnect to the second tool; coupling a second clamp to the second flexible interconnect; removing the sealing engagement to fluidicly couple the first and second portions of the internal passage; and placing at least a portion of the second flexible interconnect under tension loading, comprising engaging the second clamp with the tool trap; and suspending at least the first tool, the first flexible interconnect, and the second tool by the second flexible interconnect in response to engaging the second clamp with the tool trap. In an exemplary embodiment, the first clamp defines a first surface adapted to engage the tool trap when the first clamp engages the tool trap; wherein the second clamp defines a second surface adapted to engage the tool trap when the second clamp engages the tool trap; and wherein the method further comprises moving the first tool by a predetermined increment within the internal passage in response to placing the at least a portion of the second flexible interconnect under tension loading, wherein the predetermined increment is generally equal to the distance between the first surface of the first clamp and the second surface of the second clamp, when the portion of the second flexible interconnect is placed under tension loading. In an exemplary embodiment, the internal passage comprises a pressurized wellbore; and wherein the method further comprises deploying the first tool in the pressurized wellbore, comprising the moving the first tool by the predetermined increment within the internal passage in response to placing the at least a portion of the second flexible interconnect under tension loading. In an exemplary embodiment, at least one of the first and second clamps comprises first and second body members adapted to be coupled to each other, each of the first and second body members comprising opposing tapered end portions, at least one of the tapered end portions defining at least a portion of one of the first and second surfaces adapted to engage the tool trap; and first and second channels formed in the first and second body members, respectively; wherein, when the at least one of the first and second clamps is coupled to the corresponding flexible interconnect, the first and second body members are coupled to each other, and the first and second channels form another internal passage through which the corresponding flexible interconnect extends.

A system has been described that includes an enclosure at least partially defining an internal passage; a tool extending within the internal passage; a flexible interconnect coupled to the tool and extending within the internal passage; a clamp coupled to the flexible interconnect; a tool trap coupled to the enclosure and movable between open and closed positions; and an actuable sealer coupled to the enclosure and adapted to sealingly engage at least a portion of the flexible interconnect when the tool trap is in its closed position and is positioned between the clamp and the actuable sealer. In an exemplary embodiment, the internal passage comprises a pressurized wellbore; and wherein the system further comprises a lubricator assembly adapted to be removably coupled to the enclosure; and a first configuration in which: the lubricator assembly is removably coupled to the enclosure; and the tool trap is in its open position. In an exemplary embodiment, the system comprises a second configuration in which: the lubricator assembly is removably coupled to the enclosure; the tool trap is in its closed position; the clamp is in engaged with the tool trap; the tool trap is positioned between the clamp and the actuable sealer; the actuable sealer is positioned between the tool trap and the tool; at least a portion of the flexible interconnect between the tool trap and the tool is tension loaded; and the internal passage is pressurized and the pressure throughout at least the portion of the internal passage defined by the enclosure is generally equal. In an exemplary embodiment, the system comprises a third configuration in which: the lubricator assembly is removably coupled to the enclosure; the tool trap is in its closed position; the clamp is in engaged with the tool trap; the tool trap is positioned between the clamp and actuable sealer; the actuable sealer is positioned between the tool trap and the tool; at least a portion of the flexible interconnect between the tool trap and the tool is tension loaded; the actuable sealer sealingly engages the tension-loaded portion of the flexible interconnect to fluidicly isolate first and second portions of the internal passage, the tool trap and the clamp being disposed in the first portion of the internal passage, the tool being disposed in the second portion of the internal passage. In an exemplary embodiment, the system comprises a fourth configuration in which: the lubricator assembly is decoupled from the enclosure; the tool trap is in its closed position; the clamp is in engaged with the tool trap; the tool trap is positioned between the clamp and actuable sealer; the actuable sealer is positioned between the tool trap and the tool; at least a portion of the flexible interconnect between the tool trap and the tool is tension loaded; the actuable sealer sealingly engages the tension-loaded portion of the flexible interconnect to fluidicly isolate first and second portions of the internal passage, the tool trap and the clamp being disposed in the first portion of the internal passage, the tool being disposed in the second portion of the internal passage; the first portion of the internal passage is not pressurized; and the second portion of the internal passage is pressurized and the sealing engagement between the actuable sealer and the tension-loaded portion of the flexible interconnect contains the pressure within the second portion of the internal passage. In an exemplary embodiment, the clamp defines a first surface adapted to engage the tool trap; and wherein the clamp comprises first and second body members adapted to be coupled to each other, each of the first and second body members comprising opposing tapered end portions, at least one of the tapered end portions defining at least a portion of the first surface adapted to engage the tool trap; and first and second channels formed in the first and second body members, respectively; wherein, when the clamp is coupled to the flexible interconnect, the first and second body members are coupled to each other, and the first and second channels form another internal passage through which the flexible interconnect extends.

A system has been described that includes means for coupling a first flexible interconnect to a first tool; means for disposing at least the first flexible interconnect and the first tool in a pressurized internal passage; means for placing at least a portion of the first flexible interconnect under tension loading; and means for sealingly engaging the tension-loaded portion of the first flexible interconnect so that a first portion of the internal passage is fluidicly isolated from a second portion of the internal passage. In an exemplary embodiment, the tension loading resists any flexing of the tension-loaded portion of the first flexible interconnect to thereby facilitate the sealing engagement, and wherein means for placing the at least a portion of the first flexible interconnect under tension loading comprises means for coupling a first clamp to the first flexible interconnect; means for engaging the first clamp with a tool trap; and means for suspending at least the first tool by the first flexible interconnect in response to engaging the first clamp with the tool trap. In an exemplary embodiment, the system comprises means for releasing the pressure in the first portion of the internal passage while continuing to sealingly engage the tension-loaded portion of the first flexible interconnect so that the pressure in the second portion of the internal passage is contained. In an exemplary embodiment, the system comprises means for coupling a second tool to the first flexible interconnect; means for coupling a second flexible interconnect to the second tool; means for coupling a second clamp to the second flexible interconnect; means for removing the sealing engagement to fluidicly couple the first and second portions of the internal passage; and means for placing at least a portion of the second flexible interconnect under tension loading, comprising means for engaging the second clamp with the tool trap; and means for suspending at least the first tool, the first flexible interconnect, and the second tool by the second flexible interconnect in response to engaging the second clamp with the tool trap. In an exemplary embodiment, the first clamp defines a first surface adapted to engage the tool trap when the first clamp engages the tool trap; wherein the second clamp defines a second surface adapted to engage the tool trap when the second clamp engages the tool trap; and wherein the system further comprises means for moving the first tool by a predetermined increment within the internal passage in response to placing the at least a portion of the second flexible interconnect under tension loading, wherein the predetermined increment is generally equal to the distance between the first surface of the first clamp and the second surface of the second clamp, when the portion of the second flexible interconnect is placed under tension loading. In an exemplary embodiment, the internal passage comprises a pressurized wellbore; and wherein the system further comprises means for deploying the first tool in the pressurized wellbore, comprising the means for moving the first tool by the predetermined increment within the internal passage in response to placing the at least a portion of the second flexible interconnect under tension loading. In an exemplary embodiment, at least one of the first and second clamps comprises first and second body members adapted to be coupled to each other, each of the first and second body members comprising opposing tapered end portions, at least one of the opposing tapered end portions defining at least a portion of one of the first and second surfaces adapted to engage the tool trap; and first and second channels formed in the first and second body members, respectively; wherein, when the at least one of the first and second clamps is coupled to the corresponding flexible interconnect, the first and second body members are coupled to each other, and the first and second channels form another internal passage through which the corresponding flexible interconnect extends.

A method has been described that includes providing an enclosure at least partially defining a pressurized internal passage, the internal passage comprising a pressurized wellbore; removably coupling a lubricator assembly to the enclosure; coupling a tool trap to the enclosure; coupling a first flexible interconnect to a first tool; disposing at least the first flexible interconnect and the first tool in the pressurized internal passage; placing at least a portion of the first flexible interconnect under tension loading, comprising coupling a first clamp to the first flexible interconnect, wherein the first clamp defines a first surface adapted to engage the tool trap when the first clamp engages the tool trap; engaging the first clamp with the tool trap; and suspending at least the first tool by the first flexible interconnect in response to engaging the first clamp with the tool trap; sealingly engaging the tension-loaded portion of the first flexible interconnect so that a first portion of the internal passage is fluidicly isolated from a second portion of the internal passage, the tool trap and the first clamp being disposed in the first portion of the internal passage, the first tool being disposed in the second portion of the internal passage, wherein the tension loading resists any flexing of the tension-loaded portion of the first flexible interconnect to thereby facilitate the sealing engagement; releasing the pressure in the first portion of the internal passage while continuing to sealingly engage the tension-loaded portion of the first flexible interconnect so that the pressure in the second portion of the internal passage is contained; decoupling the lubricator assembly from the enclosure; coupling a second tool to the first flexible interconnect; coupling a second flexible interconnect to the second tool; coupling a second clamp to the second flexible interconnect, wherein the second clamp defines a second surface adapted to engage the tool trap when the second clamp engages the tool trap; removably coupling the lubricator assembly to the enclosure for a second time; removing the sealing engagement to fluidicly couple the first and second portions of the internal passage after removably coupling the lubricator assembly to the enclosure for the second time; placing at least a portion of the second flexible interconnect under tension loading, comprising engaging the second clamp with the tool trap; and suspending at least the first tool, the first flexible interconnect, and the second tool by the second flexible interconnect in response to engaging the second clamp with the tool trap; moving the first tool by a predetermined increment within the internal passage in response to placing the at least a portion of the second flexible interconnect under tension loading, wherein the predetermined increment is generally equal to the distance between the first surface of the first clamp and the second surface of the second clamp, when the portion of the second flexible interconnect is placed under tension loading; and deploying the first tool in the pressurized wellbore, comprising the moving the first tool by the predetermined increment within the internal passage in response to placing the at least a portion of the second flexible interconnect under tension loading; wherein at least one of the first and second clamps comprises first and second body members adapted to be coupled to each other, each of the first and second body members comprising opposing tapered end portions, at least one of the tapered end portions defining at least a portion of one of the first and second surfaces adapted to engage the tool trap; and first and second channels formed in the first and second body members, respectively, wherein, when the at least one of the first and second clamps is coupled to the corresponding flexible interconnect, the first and second body members are coupled to each other, and the first and second channels form another internal passage through which the corresponding flexible interconnect extends.

A method for multiple deployment within a bore has been described that includes positioning an interconnect coupled to a tool within a bore; engaging the interconnect to generate a seal; coupling a second tool to the interconnect; and disengaging the interconnect.

A method for multiple deployment within a pressurized bore has been described that includes positioning an interconnect coupled to a tool within a bore of an annular vessel; coupling the annular vessel to a pressure containment device; actuating a tool trap into a substantially open position; lowering the tool into the blowout preventer; actuating the tool trap into a substantially closed position; positioning a locating device proximate to the tool trap; engaging the interconnect to generate a seal; decoupling the annular vessel; decoupling the interconnect from the tool; coupling a second tool to a second interconnect; coupling the second tool to the first interconnect; coupling the annular vessel to the pressure containment device; and disengaging the interconnect.

An apparatus has been described that includes a locating device coupled to a wireline; a tool trap positioned adjacent to a sealing device, wherein the sealing device is capable of engaging the wireline to generate a seal; and a tool coupled to the wireline.

It is understood that variations may be made in the foregoing without departing from the scope of the disclosure. For example, instead of, or in addition to oil and gas exploration, development, and/or production operations, one or more of the above-described systems, devices and/or methods, and/or any combination thereof, may be employed in other applications, operations, and/or environments, such as, for example, telecommunication applications, electricity-related applications, or any environment utilizing a line in a bore. Furthermore, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A method comprising:

coupling a first flexible interconnect to a first tool;

disposing at least the first flexible interconnect and the first tool in a pressurized internal passage;

supporting the first flexible interconnect within the passage, including placing at least a portion of the first flexible interconnect under tension loading independent of support of a wireline, wherein the tension loading resists any flexing of the tension-loaded portion of the first flexible interconnect to facilitate a sealing engagement; and wherein placing at least a portion of the first flexible interconnect under tension loading comprises, coupling a first clamp to the first flexible interconnect;

engaging the first clamp with a tool trap; and suspending at least the first tool by the first flexible interconnect in response to engaging the first clamp with the tool trap; and sealingly engaging the tension-loaded portion of the first flexible interconnect so that a first portion of the pressurized internal passage is fluidicly isolated from a second portion of the pressurized internal passage.

2. The method of claim 1, further comprising:

releasing pressure in the first portion of the pressurized internal passage while continuing to sealingly engage the tension-loaded portion of the first flexible interconnect so that pressure in the second portion of the pressurized internal passage is contained.

3. The method of claim 2, further comprising:

coupling a second tool to the first flexible interconnect;

coupling a second flexible interconnect to the second tool;

coupling a second clamp to the second flexible interconnect;

removing the sealing engagement to fluidicly couple the first and second portions of the pressurized internal passage; and placing at least a portion of the second flexible interconnect under tension loading, including engaging the second clamp with the tool trap, and suspending at least the first tool, the first flexible interconnect, and the second tool by the second flexible interconnect in response to engaging the second clamp with the tool trap.

4. The method of claim 3, further comprising moving the first tool by a predetermined increment within the pressurized internal passage in response to placing the portion of the second flexible interconnect under tension loading, wherein the predetermined increment is generally equal to the distance between a tool trap-engaging surface of the first clamp and a tool trap-engaging surface of the second clamp.

5. The method of claim 4, wherein the pressurized internal passage comprises a pressurized wellbore; and wherein moving the first tool by the predetermined increment includes deploying the first tool in the pressurized wellbore.

6. The method of claim 5, wherein at least one of the first and second clamps include first and second body members configured to be coupled to each other, each of the first and second body members having opposing tapered end portions, at least one of the tapered end portions defining at least a portion of the tool trap-engaging surfaces, and first and second channels formed in the first and second body members, respectively;

wherein, when the first or second clamp is coupled to the corresponding flexible interconnect, the first and second body members are coupled to each other, and the first and second channels form an internal passage through which the corresponding flexible interconnect extends.

7. A system comprising:

an enclosure at least partially defining an internal passage;

a tool configured to extend within the internal passage;

a flexible interconnect coupled to the tool and configured to extend within the internal passage;

a tool trap coupled to the enclosure and movable between open and closed positions;

a clamp coupled to the flexible interconnect, the clamp defining a surface configured to engage the tool trap when in the closed position, thereby supporting the tool and placing at least a portion of the flexible interconnect under tension loading; and an actuable sealer coupled to the enclosure and configured to sealingly engage the portion of the flexible interconnect under tension loading when such portion extends between seal member surfaces of the actuable sealer.

8. The system of claim 7, wherein the internal passage comprises a pressurized wellbore.

9. The system of claim 8, further comprising a lubricator assembly configured to be removably coupled to the enclosure; and wherein the system includes a first and a second configuration, the first configuration in which:

the lubricator assembly is removably coupled to the enclosure; and the tool trap is in its open position;

the second configuration in which:

the lubricator assembly is removably coupled to the enclosure;

the tool trap is in its closed position;

the clamp is engaged with the tool trap;

the tool trap is positioned between the clamp and the actuable sealer;

the actuable sealer is positioned between the tool trap and the tool;

at least a portion of the flexible interconnect between the tool trap and the tool is tension loaded; and the internal passage is pressurized and pressure throughout at least the portion of the internal passage defined by the enclosure is generally equal.

10. The system of claim 9, further comprising:

a third configuration in which:

the lubricator assembly is removably coupled to the enclosure;

the tool trap is in its closed position;

the clamp is engaged with the tool trap;

the tool trap is positioned between the clamp and the actuable sealer;

the actuable sealer is positioned between the tool trap and the tool;

at least a portion of the flexible interconnect between the tool trap and the tool is tension loaded;

the actuable sealer sealingly engages the tension-loaded portion of the flexible interconnect to fluidicly isolate first and second portions of the internal passage, the tool trap and the clamp being disposed in the first portion of the internal passage, the tool being disposed in the second portion of the internal passage.

11. The system of claim 10, further comprising:

a fourth configuration in which:

the lubricator assembly is decoupled from the enclosure;

the tool trap is in its closed position;

the clamp is engaged with the tool trap;

the tool trap is positioned between the clamp and the actuable sealer;

the actuable sealer is positioned between the tool trap and the tool;

at least a portion of the flexible interconnect between the tool trap and the tool is tension loaded;

the actuable sealer sealingly engages the tension-loaded portion of the flexible interconnect to fluidicly isolate first and second portions of the internal passage, the tool trap and the clamp being disposed in the first portion of the internal passage, the tool being disposed in the second portion of the internal passage;

the first portion of the internal passage is not pressurized; and the second portion of the internal passage is pressurized and the sealing engagement between the actuable sealer and the tension-loaded portion of the flexible interconnect contains pressure within the second portion of the internal passage.

12. The system of claim 7, wherein the clamp includes first and second body members configured to be coupled to each other, each of the first and second body members having opposing tapered end portions, at least one of the tapered end portions defining at least a portion of the surface configured to engage the tool trap, and first and second channels formed in the first and second body members, respectively; and wherein, when the clamp is coupled to the flexible interconnect, the first and second body members are coupled to each other, and the first and second channels form an internal passage through which the flexible interconnect extends.

13. A system comprising:

a first flexible interconnect coupled to a first tool;

a pressurized internal passage configured to receive at least the first flexible interconnect and the first tool;

a first clamp coupled to the first flexible interconnect, the first clamp including a surface configured to engage with a tool trap such that, when the first clamp and the tool trap are engaged, at least the first tool is suspended by the first flexible interconnect and places at least a portion of the first flexible interconnect under tension loading; and an actuatable sealer configured to sealingly engage the tension-loaded portion of the first flexible interconnect so that a first portion of the pressurized internal passage is fluidicly isolated from a second portion of the pressurized internal passage.

14. The system of claim 13, wherein the tension loading resists any flexing of the tension-loaded portion of the first flexible interconnect to facilitate the sealing engagement.

15. The system of claim 14, further comprising:

one or more valve assemblies configured to release pressure in the first portion of the pressurized internal passage while the actuatable sealer continues to sealingly engage the tension-loaded portion of the first flexible interconnect so that pressure in the second portion of the pressurized internal passage is contained.

16. The system of claim 15, further comprising:

a second tool coupled to the first flexible interconnect;

a second flexible interconnect coupled to the second tool;

a second clamp coupled to the second flexible interconnect;

wherein the actuatable sealer is further configured to release the sealing engagement and fluidicly couple the first and second portions of the pressurized internal passage; and wherein the second clamp includes a surface configured to engage with the tool trap such that, when the second clamp and the tool trap are engaged, at least the first tool, the first flexible interconnect, and the second tool are suspended by the second flexible interconnect and place at least a portion of the second flexible interconnect under tension loading.

17. The system of claim 16, wherein engagement between the surface of the second clamp and the tool trap results in movement of the first tool by a predetermined increment within the pressurized internal passage, wherein the predetermined increment is generally equal to the distance between the tool trap-engaging surface of the first clamp and the tool trap-engaging surface of the second clamp, when the portion of the second flexible interconnect is placed under tension loading.

18. The system of claim 17, wherein the pressurized internal passage comprises a pressurized wellbore.

19. The system of claim 18, wherein at least one of the first and second clamps include first and second body members configured to be coupled to each other, each of the first and second body members having opposing tapered end portions, at least one of the opposing tapered end portions defining at least a portion of the surface configured to engage the tool trap, and first and second channels formed in the first and second body members, respectively; and wherein, when the at least one of the first and second clamps is coupled to the corresponding flexible interconnect, the first and second body members are coupled to each other, and the first and second channels form an internal passage through which the corresponding flexible interconnect extends.

20. A method comprising:

receiving or providing an enclosure at least partially defining a pressurized internal passage, the pressurized internal passage comprising a pressurized wellbore;

removably coupling a lubricator assembly to the enclosure;

coupling a tool trap to the enclosure;

coupling a first flexible interconnect to a first tool;

disposing at least the first flexible interconnect and the first tool in the pressurized internal passage;

placing at least a portion of the first flexible interconnect under tension loading, comprising:

coupling a first clamp to the first flexible interconnect, wherein the first clamp defines a first surface configured to engage the tool trap;

engaging the first clamp with the tool trap; and suspending at least the first tool by the first flexible interconnect in response to engaging the first clamp with the tool trap;

sealingly engaging the tension-loaded portion of the first flexible interconnect so that a first portion of the pressurized internal passage is fluidicly isolated from a second portion of the pressurized internal passage, the tool trap and the first clamp being disposed in the first portion of the pressurized internal passage, the first tool being disposed in the second portion of the pressurized internal passage, wherein the tension loading resists any flexing of the tension-loaded portion of the first flexible interconnect to facilitate the sealing engagement;

releasing pressure in the first portion of the pressurized internal passage while continuing to sealingly engage the tension-loaded portion of the first flexible interconnect so that pressure in the second portion of the pressurized internal passage is contained;

decoupling the lubricator assembly from the enclosure;

coupling a second tool to the first flexible interconnect;

coupling a second flexible interconnect to the second tool;

coupling a second clamp to the second flexible interconnect, wherein the second clamp defines a second surface configured to engage the tool trap;

removably coupling the lubricator assembly to the enclosure for a second time;

removing the sealing engagement to fluidicly couple the first and second portions of the pressurized internal passage after removably coupling the lubricator assembly to the enclosure for the second time;

placing at least a portion of the second flexible interconnect under tension loading, comprising:

engaging the second clamp with the tool trap; and suspending at least the first tool, the first flexible interconnect, and the second tool by the second flexible interconnect in response to engaging the second clamp with the tool trap;

moving the first tool by a predetermined increment within the pressurized internal passage in response to placing the at least a portion of the second flexible interconnect under tension loading, wherein the predetermined increment is generally equal to the distance between the first surface of the first clamp and the second surface of the second clamp, when the portion of the second flexible interconnect is placed under tension loading; and deploying the first tool in the pressurized wellbore, comprising the moving the first tool by the predetermined increment within the pressurized internal passage in response to placing the at least a portion of the second flexible interconnect under tension loading;

wherein at least one of the first and second clamps comprises:

first and second body members configured to be coupled to each other, each of the first and second body members comprising:

opposing tapered end portions, at least one of the tapered end portions defining at least a portion of one of the first and second surfaces configured to engage the tool trap; and first and second channels formed in the first and second body members, respectively, wherein, when the at least one of the first and second clamps is coupled to the corresponding flexible interconnect, the first and second body members are coupled to each other, and the first and second channels form another pressurized internal passage through which the corresponding flexible interconnect extends.

* * * * *